US009958154B2

(12) United States Patent
Colannino et al.

(10) Patent No.: US 9,958,154 B2
(45) Date of Patent: May 1, 2018

(54) SYSTEM AND METHOD FOR FLATTENING A FLAME

(71) Applicant: ClearSign Combustion Corporation, Seattle, WA (US)

(72) Inventors: Joseph Colannino, Bellevue, WA (US); Thomas S. Hartwick, Snohomish, WA (US); David B. Goodson, Bellevue, WA (US); Tracy A. Prevo, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 948 days.

(21) Appl. No.: 13/658,766

(22) Filed: Oct. 23, 2012

(65) Prior Publication Data

US 2013/0071794 A1 Mar. 21, 2013

Related U.S. Application Data

(63) Continuation of application No. PCT/US2012/024571, filed on Feb. 9, 2012.

(60) Provisional application No. 61/441,229, filed on Feb. 9, 2011.

(51) Int. Cl.

| | |
|---|---|
| ***F23C 99/00*** | (2006.01) |
| ***F23D 14/84*** | (2006.01) |
| ***F23C 5/14*** | (2006.01) |
| ***F23N 5/26*** | (2006.01) |

(52) U.S. Cl.

CPC ..... *F23C 99/001* (2013.01); *F23C 5/14* (2013.01); *F23D 14/84* (2013.01); *F23N 5/265* (2013.01)

(58) Field of Classification Search

CPC ..... F23C 99/001; F23D 11/32
USPC ..... 431/2
See application file for complete search history.

(56) References Cited

U.S. PATENT DOCUMENTS

| | | | | |
|---|---|---|---|---|
| 1,983,430 | A | | 12/1934 | Ashcraft |
| 2,604,936 | A | * | 7/1952 | Kaehni et al. ..... 432/9 |
| 2,963,864 | A | * | 12/1960 | Gross ..... 60/39.827 |
| 3,087,472 | A | * | 4/1963 | Asakawa ..... 123/1 R |
| 3,224,485 | A | * | 12/1965 | Blomgren, Sr. et al. ..... 432/24 |
| 3,269,446 | A | * | 8/1966 | Luther ..... 431/172 |
| 3,306,338 | A | * | 2/1967 | Wright et al. ..... 431/202 |
| 3,416,870 | A | * | 12/1968 | Wright ..... 431/2 |
| 3,489,350 | A | | 1/1970 | Caparone |
| 4,052,139 | A | * | 10/1977 | Paillaud et al. ..... 431/2 |
| 4,111,636 | A | * | 9/1978 | Goldberg ..... 431/2 |
| 4,528,917 | A | | 7/1985 | Jacobs |
| 4,635,566 | A | * | 1/1987 | O'Connor ..... 110/106 |
| 6,640,549 | B1 | | 11/2003 | Wilson et al. |
| 6,742,340 | B2 | | 6/2004 | Nearhoof, Sr. et al. |

(Continued)

OTHER PUBLICATIONS

PCT International Search Report and Written Opinion of PCT Application No. PCT/US2012/024571 dated May 23, 2012.

*Primary Examiner* — Alissa Tompkins
*Assistant Examiner* — Deepak Deean
(74) *Attorney, Agent, or Firm* — Christopher A. Wiklof; Nicholas S. Bromer; Launchpad IP, Inc.

(57) ABSTRACT

A charge electrode configured to impart a time-varying charge to a flame and a shape electrode located outside the flame may be driven synchronously by a voltage source through time varying voltage(s). The flame may be flattened or compressed responsive to an electric field produced by the shape electrode acting on the charges imparted to the flame.

78 Claims, 6 Drawing Sheets

(56) References Cited

U.S. PATENT DOCUMENTS

| | | | | |
|---|---|---|---|---|
| 7,137,808 | B2 * | 11/2006 | Branston et al. | 431/8 |
| 7,217,121 | B2 * | 5/2007 | Thomson et al. | 431/12 |
| 7,243,496 | B2 * | 7/2007 | Pavlik et al. | 60/776 |
| 7,377,114 | B1 | 5/2008 | Pearce | |
| 7,845,937 | B2 * | 12/2010 | Hammer et al. | 431/2 |
| 8,245,951 | B2 | 8/2012 | Fink et al. | |
| 2004/0115577 | A1 | 6/2004 | Maenishi | |
| 2004/0185397 | A1 * | 9/2004 | Branston et al. | 431/2 |
| 2005/0208442 | A1 * | 9/2005 | Heiligers et al. | 431/1 |
| 2007/0020567 | A1 | 1/2007 | Branston | |
| 2011/0027734 | A1 | 2/2011 | Hartwick | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |

* cited by examiner

SYSTEM AND METHOD FOR FLATTENING A FLAME

CROSS-REFERENCE TO RELATED APPLICATIONS

The present application is copending with and is a continuation of International Application No. PCT/US2012/024571, entitled "SYSTEM AND METHOD FOR FLATTENING A FLAME", filed Feb. 9, 2012; which claims priority benefit under 35 USC § 119(e) from U.S. Provisional Application Ser. No. 61/441,229, entitled "METHOD AND APPARATUS FOR ELECTRICALLY ACTIVATED HEAT TRANSFER", invented by Thomas S. Hartwick, et al., filed on Feb. 9, 2011; both of which, to the extent not inconsistent with the disclosure herein, are incorporated by reference in their entireties.

The present application is related to U.S. Non-Provisional patent application Ser. No. 13/370,183, entitled "ELECTRIC FIELD CONTROL OF TWO OR MORE RESPONSES IN A COMBUSTION SYSTEM", invented by Thomas S. Hartwick, et al., filed on Feb. 9, 2012; which, to the extent not inconsistent with the disclosure herein, is incorporated by reference in its entirety.

The present application is related to U.S. Non-Provisional patent application Ser. No. 13/370,280, entitled "METHOD AND APPARATUS FOR ELECTRODYNAMICALLY DRIVING A CHARGED GAS OR CHARGED PARTICLES ENTRAINED IN A GAS", invented by David B. Goodson et al., filed on Feb. 9, 2012; which, to the extent not inconsistent with the disclosure herein, is incorporated by reference in its entirety.

BACKGROUND

Historically, flame shapes achievable in industrial burners, boilers, and other systems have been determined by inertial and buoyancy forces acting on the flame. Such limited control over flame shape has dictated design choices available to engineers.

What is needed is a technology that can provide more degrees of freedom to combustion engineers, and allow new and novel capabilities and characteristics in systems that include flames.

SUMMARY

According to an embodiment, an apparatus for flattening a flame may include a charge electrode disposed proximal to a burner and configured to be at least intermittently in contact with a flame supported by the burner and a shape electrode disposed distal to the burner relative to the charge electrode. A voltage source may be operatively coupled to the charge electrode and the shape electrode, and configured to apply to the charge electrode and shape electrode a substantially in-phase time-varying electrical potential. Applying the substantially in-phase time-varying electrical potential to the charge electrode and the shape electrode by the voltage source has been found to cause the flame to flatten into a smaller volume compared to not applying the substantially in-phase time-varying electrical potential.

According to an embodiment, a method for flattening a flame may include supporting a charge electrode proximal to a burner and at least intermittently in contact with a flame supported by the burner, supporting a shape electrode distal to the burner relative to the charge electrode, and applying substantially in-phase time-varying voltages to the charge electrode and the shape electrode.

According to embodiments, the flame may be flattened using a large torus as the shape electrode and central charge rod as the charge electrode. The large torus and the charge rod were tied to the same alternating electrical potential of ±40 kV. The alternating field was found to allow higher voltages while reducing the incidence dielectric breakdown. Application of the electrical waveform was found to compress the flame down to a height of ⅓ or less of the flame without the electrical waveform applied. The direction of compression was in opposition to buoyancy and inertial forces acting on the flame. Substantially the same or greater heat release was found to occur in the smaller volume.

DETAILED DESCRIPTION

Figure 1:
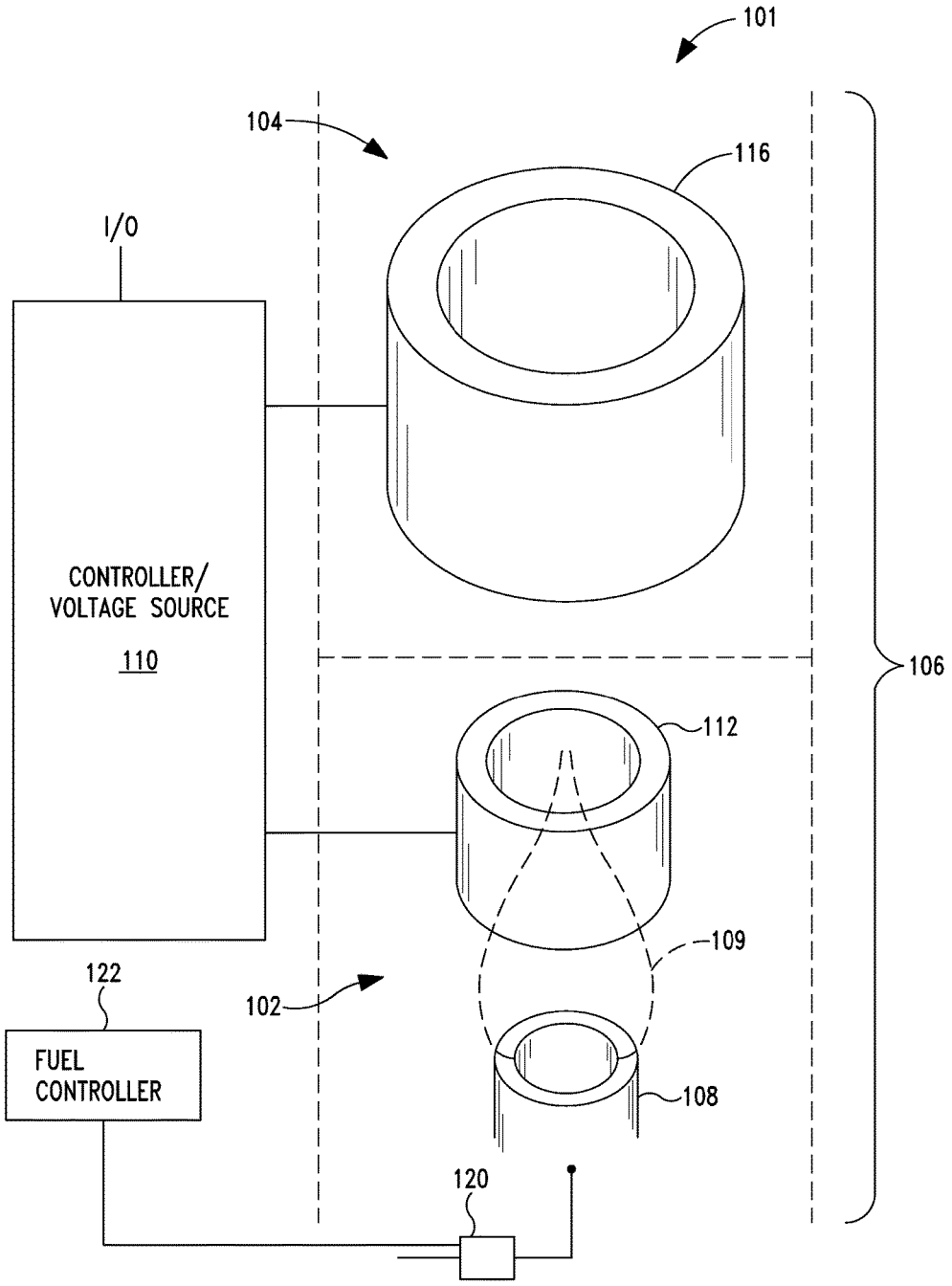
FIG. 1 is a diagram of an apparatus for flattening a flame, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram of an apparatus 101 for flattening a flame 109, according to an embodiment. A charge electrode 112 may be disposed proximal to a burner 108 and be configured to be at least intermittently in contact with a flame 109 supported by the burner 108. A shape electrode 116 may be disposed distal to the burner 108 relative to the charge electrode 112. A voltage source such as an electrode controller 110 may be operatively coupled to the charge electrode 112 and the shape electrode 116, and may be configured to apply to the charge electrode 112 and shape electrode 116 one or more substantially in-phase time-varying electrical potential(s). The applied time-varying electrical potential(s) may cause the flame 109 to flatten into a smaller volume compared to not applying the substantially in-phase time-varying electrical potential.

As shown in FIG. 1, a combustion volume 106 may include a region 102 relatively near the burner 108 and a region 104 disposed distal to the burner 108. Flattening the flame 109 may include compressing a flame 109 that formerly occupied both regions 102 and 104 into a size that fits within the region 102. The substantially in-phase, time varying electrical potential (s) may cause the flame 109 to increase in brightness compared to not applying the substantially in-phase time-varying electrical potential. Applying the substantially in-phase time-varying electrical potential to the charge electrode and the shape electrode may cause the flame 109 to maintain or increase its heat output compared to not applying the substantially in-phase time-varying electrical potential.

Figure 5:
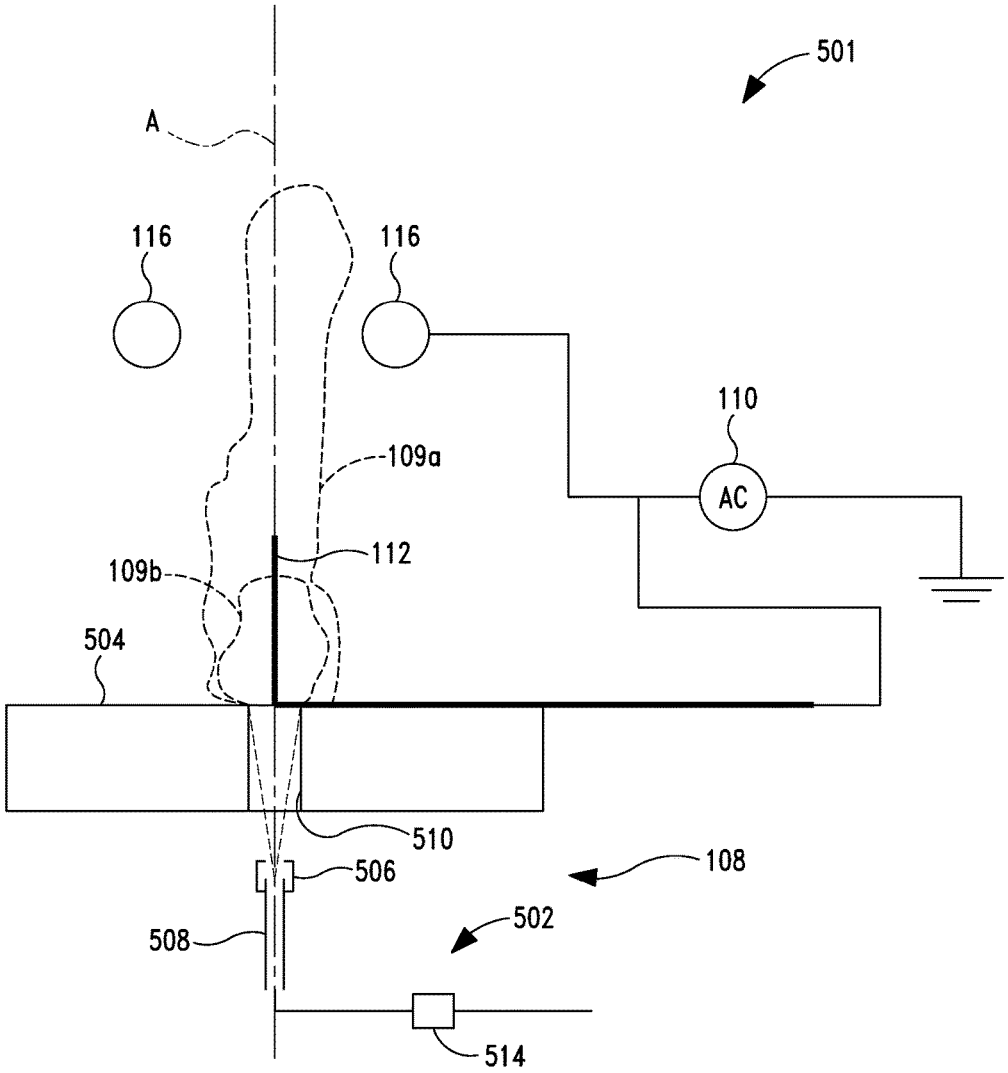
FIG. 5 is a diagram of an experimental apparatus showing an experimental result, according to an embodiment.

Referring to FIG. 5, the burner 108 may include a bluff-body 504 configured as a flame holder. The maximum heat output by a conventional burner may be determined by maximum fuel and air flow rates, beyond which the flame may exhibit blow-off. According to embodiments, the apparatus 101 shown in FIG. 1 may be used not only to flatten a flame 109, but also to increase the flame holding capacity of the bluff-body 504. This may be used, for example, to increase the heat output capacity of the burner 108 and/or to increase capacity of a system heated by the burner 108.

The apparatus 101 may optionally include a fuel feed rate apparatus and fuel controller 122 operatively coupled to the fuel feed rate apparatus. The fuel controller may be configured to cause the fuel feed rate apparatus to increase a fuel feed rate when the voltage source applies the substantially in-phase time-varying electrical potential to the charge electrode 112 and shape electrode 116. The fuel feed rate apparatus 120 may include an actuated valve for controlling a flow rate of a gaseous or liquid fuel to the burner 108. Alternatively, the fuel feed apparatus may include an auger or eductor-jet pump for delivering a pulverized solid fuel to the burner 108. The fuel controller 122 may be configured to cause a rate of fuel feed to the burner 108 that would cause flame blow-off in the absence of applying the substantially in-phase time varying electrical potential to the charge electrode 112 and the shape electrode 116.

The shape electrode 116 may include a toroid such as a torus, as shown in FIG. 5, or a rectangle of revolution, as shown in FIG. 1.

The charge electrode 112 may include a rod disposed at least partially within the flame 109 or a toroid or torus disposed at least partially within the flame 109. Alternatively, the charge electrode 112 may include a conductive portion of the burner 108. The charge electrode 112 may be configured to impart a time-varying charge to the flame, having instantaneously the same sign as the time-varying electrical potential.

According to an embodiment, the time-varying electrical potential may include a time-varying electrical potential such as a sign-varying waveform and/or a periodic voltage waveform. The waveform may include a sinusoidal waveform, square waveform, triangular waveform, sawtooth waveform, or Fourier series waveform, for example. In at least some embodiments, the time-varying electrical potential may be characterized as an AC voltage waveform. The voltage source 110 may be configured to apply voltage(s) to the electrodes having a magnitudes that would cause dielectric breakdown if the voltage were not time-varying.

According to an embodiment, the voltage source 110 may be configured to apply a periodic electrical potential having a frequency between 50 and 10,000 Hertz, or more particularly between 50 and 1000 Hertz. The voltage source may be configured to apply a time-varying electrical potential of ±1000 Volts to ±115,000 Volts (e.g. a sign-varying waveform that includes a maximum voltage of +1000 V and a minimum voltage of −1000V or a sign-varying waveform that includes a maximum voltage of +115 kV and a minimum voltage of −115 kV). In some embodiments, the voltage source 110 may be configured to apply a time-varying electrical potential of ±8000 Volts to ±40,000 Volts.

The voltage source 110 may be configured to maintain a voltage ratio between the charge electrode 112 and the shape electrode 116 and/or may be configured to apply substantially the same voltage to the charge electrode 112 and the shape electrode 116. The charge electrode 112, the shape electrode 116, and the voltage source 110 may be configured to cooperate to avoid dielectric breakdown. The voltage source may be configured to maintain a periodic electrical potential phase applied to the shape electrode 116 within $\pm\pi/4$ or within $\pm\pi/8$ of a phase of the periodic electrical potential applied to the charge electrode 112.

Typically, the apparatus 101 may include electrical leads from the voltage source 110 to the charge electrode 112 and the shape electrode 116. The time-varying electrical potentials applied to the shape electrode 112 and the charge electrode 116 may, in some embodiments, differ by no more than a difference attributable to a propagation delay through the electrical leads.

According to embodiments, the charge electrode 112, the shape electrode 116, and the voltage source 110 may be configured to cooperate to compress the flame 109 into an etendue smaller than an etendue of the flame without application of the time-varying electrical potential. According to embodiments, the apparatus 101 may include a burner housing having smaller volume than a burner housing needed for a flame 109 without application of the time-varying electrical potential. Additionally or alternatively, the flattened flame 109 may act as a heat source having a higher temperature compared to a heat source formed by the flame in the absence of the time-varying electrical potential.

As shown, for example, in the embodiment described with reference to FIG. 6, the apparatus 101 may further include a surface configured to receive energy from the flame 109. For example the flattened flame 109 may be used to provide heat to an industrial process, a heating system, an electrical power generation system, a land vehicle, watercraft, or aircraft including an apparatus configured to receive energy from the flame, and/or a structure configured to hold a workpiece to receive energy from the flame. The compressed flame 109 (and the apparatus 101 used to compress the flame 109) may provide a range of advantages to the overall system, including portions other than the heating system itself.

Figure 2:
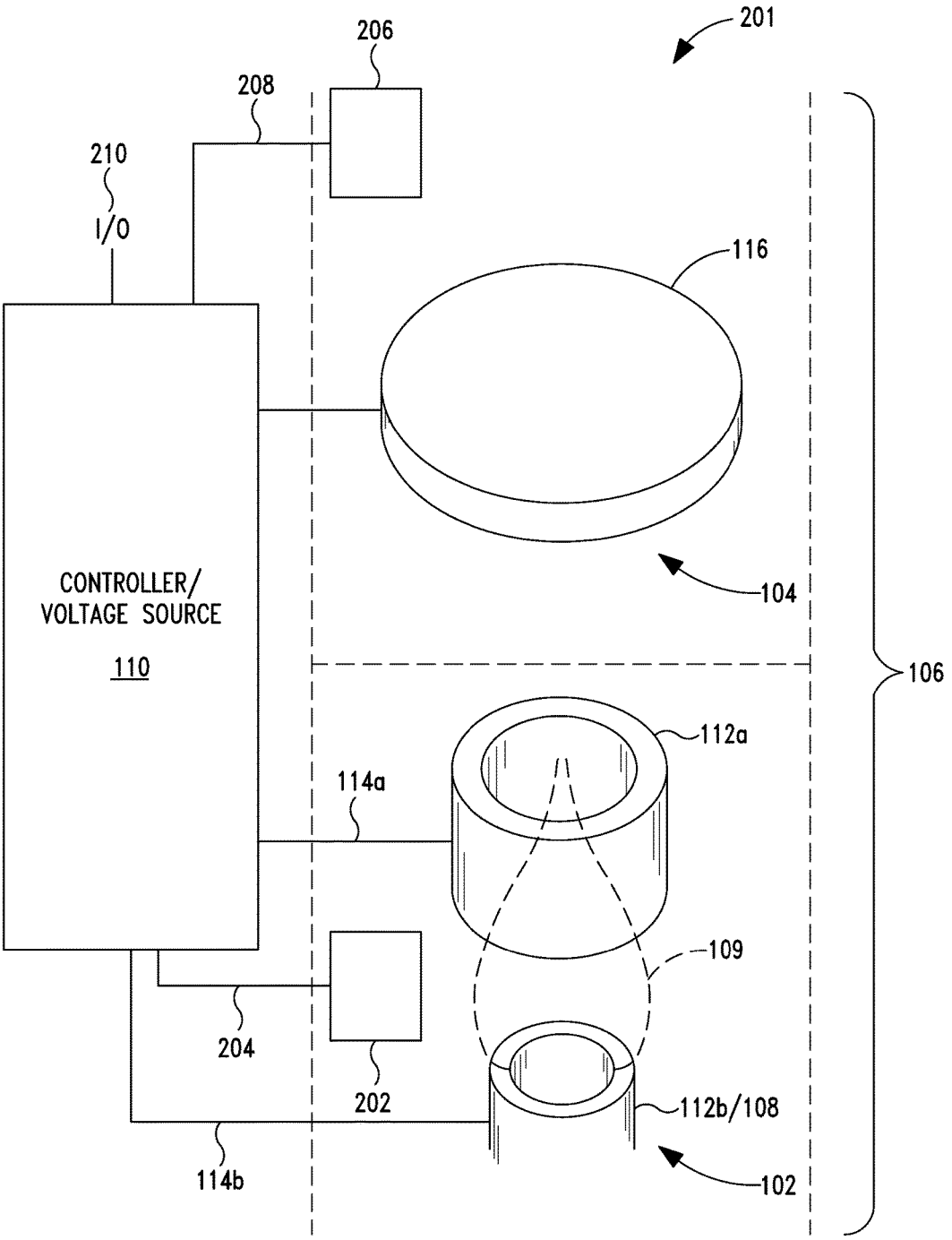
FIG. 2 is a diagram showing a system including sensors configured to provide feedback signals to an electrode controller, according to an embodiment.

FIG. 2 is a diagram showing a system including sensors configured to provide feedback signals to an electrode controller, according to an embodiment. The voltage source or an electrode controller 110 may be operatively coupled to one or more sensors 202, 206 that are configured to sense one or more attributes of the flame 109 or combustion gas produced by the flame 109. The electrode controller 110 may be configured to determine one or more of a voltage, a frequency, a waveform, a phase, or an on/off state corresponding to the time-varying electrical potential applied to the charge electrode 112 and the shape electrode 116 responsive to signals received from the one or more sensors 202, 206.

At least one first sensor 202 may be disposed to sense a condition proximate the flame 109 supported by the burner 108. The first sensor(s) 202 may be operatively coupled to the electronic controller 110 via a first sensor signal transmission path 204. The first sensor(s) 202 may be configured to sense a combustion parameter of the flame 109. For example, the sensor(s) 202 may include one or more of a flame luminance sensor, a photo-sensor, an infrared sensor, a fuel flow sensor, a temperature sensor, a flue gas temperature sensor, an acoustic sensor, a CO sensor, an $O_2$ sensor, a radio frequency sensor, and/or an airflow sensor.

At least one second sensor 206 may be disposed to sense a condition distal from the flame 109 supported by the burner 108 and operatively coupled to the electronic controller 110 via a second sensor signal transmission path 208. The at least one second sensor 206 may be disposed to sense a parameter corresponding to a condition in the second portion 104 of the heated volume 106.

For example, for an embodiment where the second portion 104 includes a pollution abatement zone, the second sensor may sense optical transmissivity corresponding to an amount of ash present in the second portion 104 of the heated volume 106. According to various embodiments, the second sensor(s) 206 may include one or more of a transmissivity sensor, a particulate sensor, a temperature sensor, an ion sensor, a surface coating sensor, an acoustic sensor, a CO sensor, an $O_2$ sensor, and an oxide of nitrogen sensor.

According to an embodiment, the second sensor 206 may be configured to detect unburned fuel. The at least one shape electrode 116 may be configured, when driven, to force unburned fuel downward and back into the first portion 102 of the heated volume 106. For example, unburned fuel may be positively charged. When the second sensor 206 transmits a signal over the second sensor signal transmission path 208 to the controller 110, the controller 110 may drive the shape electrode 116 to a positive state to repel the unburned fuel. Fluid flow within the heated volume 106 may be driven by electric field(s) formed by the at least one shape electrode 116 and/or the at least one charge electrode 112 to direct the unburned fuel downward and into the first portion 102, where it may be further oxidized by the flame 109, thereby improving fuel economy and reducing emissions.

Optionally, the controller 110 may drive the charge electrode portion 112*a* of the at least one charge electrode and/or the charge electrode portion 112*b* of the at least one charge electrode to cooperate with the at least one shape electrode 116. According to some embodiments, such cooperation may drive the unburned fuel downward more effectively than by the actions of the at least one shape electrode 116 alone.

Figure 3:
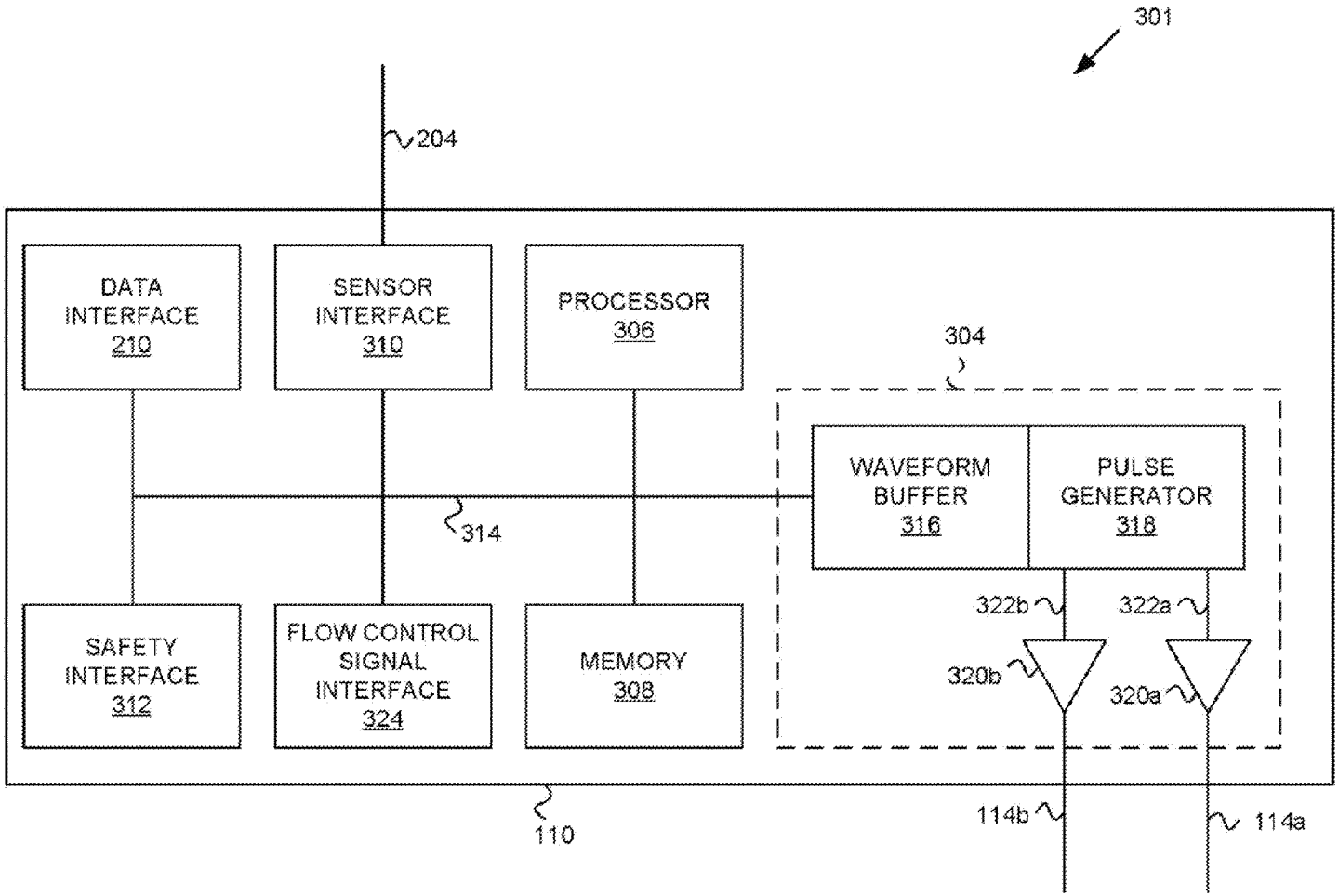
FIG. 3 is a block diagram of an electrode controller that may be used by embodiments corresponding to FIGS. 1 and 2, made according to an embodiment.

Referring to FIG. 3, the apparatus 101 for flattening a flame 109, wherein the controller 110 may further include an electrode controller 110 including a logic circuit (which may be embodied as a processor 306, memory 308, and a computer bus 314, for example), a waveform generator 304, and at least one amplifier 320*a*, 320*b* configured to cooperate to apply the time-varying electrical potential to the charge electrode 112 and the shape electrode 116.

FIG. 3 is a block diagram of an illustrative embodiment 301 of a controller 110. The controller 110 may drive the charge electrode 112 drive signal transmission paths 114*a* and 114*b* to produce the first electric field whose characteristics are selected to provide at least a first effect in the first combustion volume portion 102. The controller 110 may include a waveform generator 304. The waveform generator 304 may be disposed internal to the controller 110 or may be located separately from the remainder of the controller 110. At least portions of the waveform generator 304 may alternatively be distributed over other components of the electronic controller 110 such as a microprocessor 306 and memory circuitry 308. An optional sensor interface 310, communications interface 210, and safety interface 312 may be operatively coupled to the microprocessor 306 and memory circuitry 308 via a computer bus 314.

Logic circuitry, such as the microprocessor 306 and memory circuitry 308 may determine parameters for electrical pulses or waveforms to be transmitted to the charge electrode(s) 112 via the charge electrode 112 drive signal transmission path(s) 114*a*, 114*b*. The charge electrode(s) 112 in turn produce the first electrical field. The parameters for the electrical pulses or waveforms may be written to a waveform buffer 316. The contents of the waveform buffer 316 may then be used by a pulse generator 318 to generate low voltage signals 322*a*, 322*b* corresponding to electrical pulse trains or waveforms. For example, the microprocessor 306 and/or pulse generator 318 may use direct digital synthesis to synthesize the low voltage signals. Alternatively, the microprocessor 306 may write variable values corresponding to waveform primitives to the waveform buffer 316. The pulse generator 318 may include a first resource operable to run an algorithm that combines the variable values into a digital output and a second resource that performs digital to analog conversion on the digital output.

One or more outputs are amplified by amplifier(s) 320*a* and 320*b*. The amplified outputs are operatively coupled to the charge electrode signal transmission path(s) 114*a*, 114*b*. The amplifier(s) 320*a*, 320*b* may include programmable amplifiers. The amplifier(s) 320*a*, 320*b* may be programmed according to a factory setting, a field setting, a parameter received via the communications interface 210, one or more operator controls and/or algorithmically. Additionally or alternatively, the amplifiers 320*a*, 320*b* may include one or more substantially constant gain stages, and the low voltage signals 322*a*, 322*b* may be driven to variable amplitude. Alternatively, output may be fixed and the heated volume portions 102, 104 may be driven with electrodes having variable gain.

The pulse trains or drive waveforms output on the electrode signal transmission paths 114*a*, 114*b* may include a DC signal, an AC signal, a pulse train, a pulse width modulated signal, a pulse height modulated signal, a chopped signal, a digital signal, a discrete level signal, and/or an analog signal.

According to an embodiment, a feedback process within the controller 110, in an external resource (such as a host computer or server) (not shown), in a sensor subsystem (not shown), or distributed across the controller 110, the external resource, the sensor subsystem, and/or other cooperating circuits and programs may control the charge electrode(s) 112*a*, 112*b* and/or the shape electrode(s) 116. For example, the feedback process may provide variable amplitude or current signals in the at least one charge electrode signal transmission path 114*a*, 114*b* responsive to a detected gain by the at least one charge electrode 112 or response ratio driven by the electric field.

The sensor interface 310 may receive or generate sensor data (not shown) proportional (or inversely proportional, geometrical, integral, differential, etc.) to a measured condition in the first portion 102 of the heated volume 106.

The sensor interface 310 may receive first and second input variables from respective sensors 202, 206 responsive to physical or chemical conditions in the first and second portions 102, 104 of the heated volume 106. The controller 110 may perform feedback or feed forward control algorithms to determine one or more parameters for the first and second drive pulse trains, the parameters being expressed, for example, as values in the waveform buffer 316.

Optionally, the controller 110 may include a flow control signal interface 324. The flow control signal interface 324 may be used to generate flow rate control signals to control fuel flow and/or air flow through the combustion system.

Figure 4:
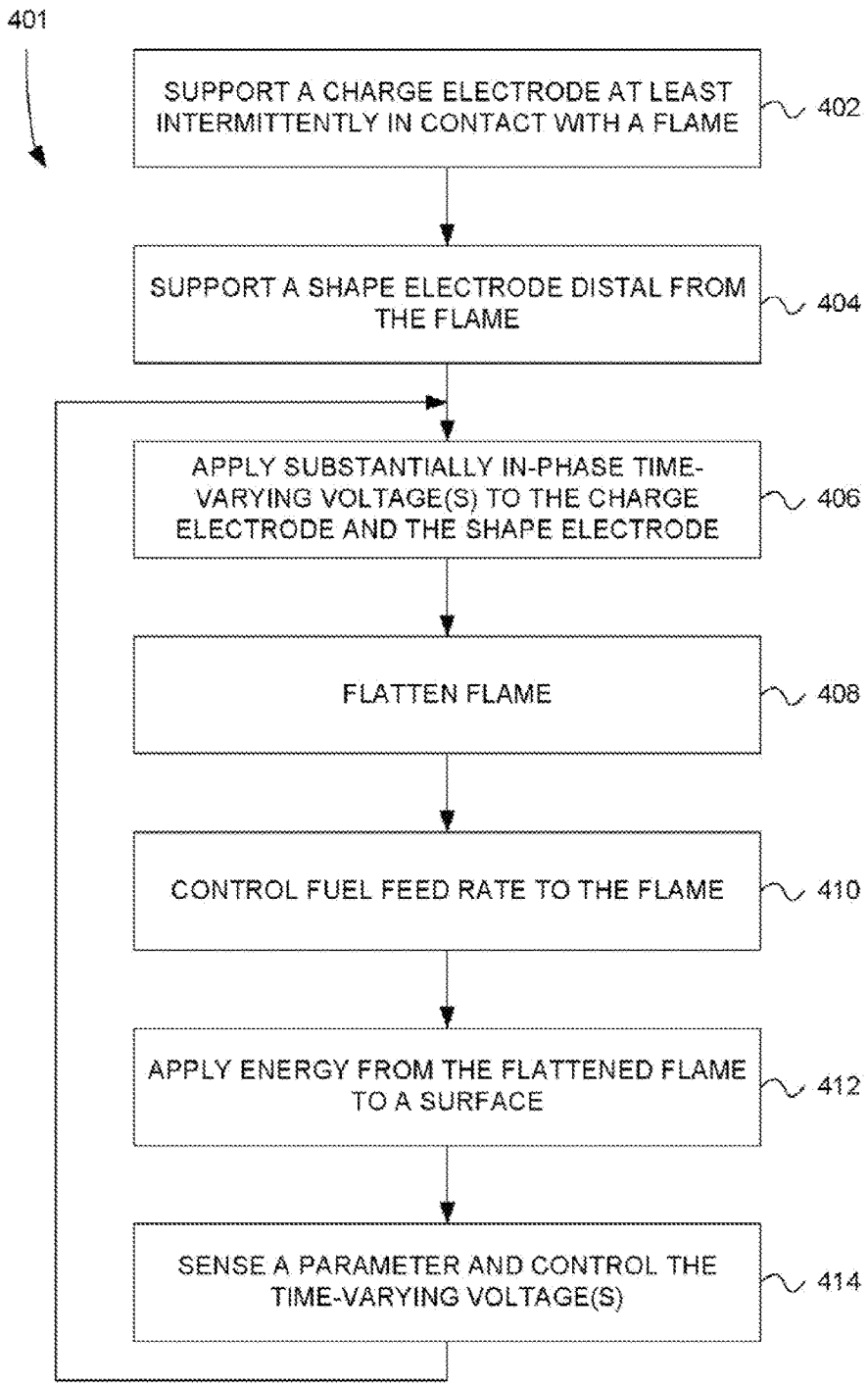
FIG. 4 is a flow chart showing a method for flattening a flame, according to an embodiment.

FIG. 4 is a flow chart showing a method 401 for flattening a flame, according to an embodiment. Beginning with step 402, a charge electrode may be supported proximal to a burner and at least intermittently in contact with a flame supported by the burner, while (in step 404) a shape electrode is supported distal to the burner relative to the charge electrode. Proceeding to step 406, one or more substantially in-phase time-varying voltages may be applied to the charge electrode and the shape electrode, the application of which results in flattening the flame in step 408.

Referring to FIG. 5, applying the substantially in-phase time-varying voltages to the charge electrode and the shape electrode in step 406 was found to cause the flame to flatten into a smaller volume (indicated by the illustrative flame outline 109*b*) compared to not applying the substantially in-phase time-varying voltages. The shape of the flame without the application of the one or more substantially in-phase time-varying voltages is illustratively indicated by the flame outline 109*a*.

Applying the substantially in-phase time-varying voltages to the charge electrode and the shape electrode was found to cause the flame 109*b* to increase in brightness compared to not applying the substantially in-phase time-varying voltages. Applying the substantially in-phase time-varying voltages to the charge electrode and the shape electrode may cause the flame 109*b* to maintain or increase its heat output compared to not applying the substantially in-phase time-varying voltages (109*a*).

Referring again to FIG. 4, the method 401 may optionally include step 410, wherein a fuel feed rate may be controlled to increase the rate of fuel fed to the flame when the substantially in-phase time varying voltages are applied to the charge electrode and the shape electrode. Controlling a fuel feed rate in step 410 may include actuating a valve for controlling a flow rate of a gaseous or liquid fuel to the burner or actuating an auger or eductor-jet pump for delivering a pulverized solid fuel to the burner, for example. The application of the substantially in-phase time-varying voltage(s) to the flame in step 406 may allow step 410 to include causing a (higher) rate of fuel fed to the burner that would cause flame blow-off in the absence of applying the substantially in-phase time varying voltage to the charge electrode and the shape electrode.

Supporting a shape electrode distal to the burner relative to the charge electrode in step 404 may include supporting a toroid-shaped or torus-shaped shape electrode. It was found that a torus having an inner diameter larger than an average diameter of the flame 109*a* would provide the desired flame flattening while reducing or eliminating thermal degradation of the shape electrode.

Supporting a charge electrode proximal to a burner and at least intermittently in contact with a flame supported by the burner in step 402 may include supporting a rod at least partially within the flame 109*a*, 109*b* or supporting a torus at least partially within the flame 109*a*, 109*b*. Optionally, supporting a charge electrode proximal to a burner and at least intermittently in contact with a flame supported by the burner may include supporting a conductive portion of the burner. For example, when the burner includes a conductive portion, the conductive portion of the burner itself may function as the charge electrode.

Referring to step 406, applying substantially in-phase time-varying voltages to the charge electrode and the shape electrode may include applying substantially in-phase periodic voltages to the charge electrode and the shape electrode. The substantially in-phase periodic voltages applied to the charge electrode and the shape electrode may include one or more sign-varying waveform(s) such as an AC voltage waveform. Applying substantially in-phase periodic voltages to the charge electrode and the shape electrode may include applying a sinusoidal waveform, a square waveform, a triangular waveform, a sawtooth waveform, or a Fourier series waveform to the charge electrode and the shape electrode.

The time-varying voltage(s) applied to the charge electrode typically results in imparting a time-varying charge to the flame, having instantaneously the same sign as the time-varying voltage applied to the charge electrode. For example, when the voltage on the charge electrode swings positive, the charge electrode may tend to attract negatively charged particles such as electrons from the flame, leaving a positive charge in the flame or at least a portion of the flame. Conversely, when the voltage on the charge electrode swings negative, the charge electrode may tend to attract positively charged particles such as fuel fragments, fuel agglomerations, or protons, leaving a negative charge in the flame or at least a portion of the flame. Because the shape electrode instantaneously swings to the same (positive or negative) sign voltage (within the limits of the ability of the voltage source to maintain phase or within the limits of a selected phase relationship), the electric field between the shape electrode and the charged particles may tend to cause an electric repulsion, which causes the flame to flatten away from the shape electrode and toward the burner and the charge electrode.

It was found to be advantageous for the voltages applied to the charge electrode and the shape electrode to include time-varying or periodic changes in sign in order to avoid dielectric breakdown (arcing) between the electrodes and surrounding structures or between the electrodes and the flame. Applying substantially in-phase time-varying voltages to the charge electrode and the shape electrode may thus include applying voltages having a magnitude that would cause dielectric breakdown if the voltages were not time-varying.

Applying substantially in-phase time-varying voltages to the charge electrode and the shape electrode may include applying periodic voltages having a frequency between 50 and 10,000 Hertz. More particularly, applying substantially in-phase time-varying voltages to the charge electrode and the shape electrode may include applying periodic voltages having a frequency between 50 and 1000 Hertz. Applying substantially in-phase time-varying voltages to the charge electrode and the shape electrode may include applying (AC) voltages between ±1000 Volts and ±115,000 Volts (i.e., a periodic waveform having a symmetric amplitude (Non DC-offset) of +1000 Volts and −1000 Volts, having a symmetric amplitude of +115 kV and −115 kV, or having amplitudes between these values. The amplitudes may alternatively be non-symmetric (include a DC bias voltage superimposed over the time-varying waveform). More particularly, applying substantially in-phase time-varying voltages to the charge electrode and the shape electrode may include applying voltages between ±8000 Volts and ±40,000 Volts.

According to an embodiment, applying substantially in-phase time-varying voltages to the charge electrode and the shape electrode may include maintaining a voltage ratio (such as 1:1 or other than 1:1) between the charge electrode and the shape electrode. Additionally or alternatively, applying substantially in-phase time-varying voltages to the charge electrode and the shape electrode may include applying substantially the same voltage to the charge electrode and the shape electrode. Applying substantially in-phase time-varying voltages to the charge electrode and the shape electrode may include avoiding dielectric breakdown.

In some embodiments, applying substantially in-phase time-varying voltages to the charge electrode and the shape electrode may include maintaining a periodic voltage phase applied to the shape electrode within $\pm\pi/4$ or within $\pm\pi/8$ of a phase of the periodic voltage applied to the charge electrode. Applying substantially in-phase time-varying voltages to the charge electrode and the shape electrode may includes applying voltages through electrical leads from a voltage source to the charge electrode and the shape electrode. According to an embodiment, any phase difference between the time varying voltages applied to the charge electrode and the shape electrode may be attributable to a propagation delay through the electrical leads.

Proceeding to step 412, energy may be applied from the (flattened) flame to a surface. For example, applying energy from the flame to a surface may include one or more of applying energy to an industrial process, applying energy to a heating system, applying energy to an electrical power generation system, applying energy to a land vehicle, watercraft, or aircraft, or applying energy to a workpiece. The flattened or compressed flame may provide a higher temperature heat source, a smaller heat generation apparatus, a smaller etendue for conveying radiation from the flame, or include other advantages enjoyed by the overall process.

Optionally, the method 401 may include step 414. In step 414, one or more attributes of the flame or combustion gas produced by the flame may be sensed and one or more of a voltage, a frequency, a waveform, a phase, or an on/off state corresponding to the time-varying voltage applied to the charge electrode and the shape electrode controlled responsive to sensing the one or more attributes. The process may then loop back to step 406 where the modified time-varying voltage attribute applied to perform step 406.

The following example provides results of an experiment related to the disclosure herein.

EXAMPLES

Referring to FIG. 5, an experimental apparatus 501 was constructed. A burner 108 included an electrically isolated fuel source 502. The fuel source 502 included a 0.775 inch diameter hole formed in a threaded ¾ inch steel pipe end 506. The threaded steel end 506 was mounted on a piece of ¾ inch steel pipe 508 about 8 inches in length. A non-conductive hose was secured to an upstream end of the fuel pipe 508 and to a propane fuel tank. Propane was supplied at a pressure of about 8 PSIG.

The burner 108 also included a bluff body 504 formed from a castable refractory material to form an approximately 3 inch thick slab including an aperture 510 about 1.5 inches in diameter. A longitudinal axis of the fuel source 502 was aligned axially to the aperture formed in the bluff body 504. The fuel source 502 was positioned with the 0.775 inch diameter hole about 2.5 inches below the bottom surface of the bluff body and directed normal to the nominal plane of the bluff body slab such that the upper surface of the aperture in the bluff body formed a flame holder.

A charge electrode 112 was formed from about ¼ inch diameter type 306 stainless steel rod. The charge electrode may alternatively be referred to as an energization electrode. The charge electrode included a substantially 90° bend 6 inches from the end such that the upper end of the charge electrode was supported 6 inches above the top surface of the bluff body 504.

A shape electrode 116 was formed from stamped or machined aluminum pieces that were joined at their edges to form a hollow torus. The torus had a 1.5 inch section of revolution that had a 7 inch inside diameter and a 10 inch outside diameter. The torus 116 was supported with its axis of revolution aligned normal to the bluff body 504 top surface and centered laterally to form a common axis A with the fuel source 502, the aperture in the bluff body 504 and the vertical portion of the charge electrode 112. The bottom edge of the torus 116 was supported 13.75 inches above the top surface of the bluff body 504. As shown in FIG. 5, during operation of the apparatus 501, the stainless steel charge electrode 112 was in substantially continuous physical and electrical contact with the flame 109*a*/109*b*.

A voltage source 110 was coupled to the charge electrode 112 and the shape electrode 116. The voltage source 110 included a National Instruments PXI-5412 waveform generator mounted in a National Instruments NI PXIe-1062Q chassis. The waveform was amplified 4000× (4000 times gain) by a TREK Model 40/15 high voltage amplifier whose output was coupled to the charge electrode 112 and the shape electrode 116 by electrical leads supplied by TREK.

The apparatus 501 was first run without applying any voltage to the charge electrode 112 or the shape electrode 116. A valve 514 on the fuel source was adjusted to produce a non-flattened flame 109*a* that extended above the bluff body 504 and through the center of the torus 116 approximately according to the shape 109*a* indicated in FIG. 5. The shape of the flame 109*a* was chaotic, but generally extended through and did not contact the torus 116. The flame 109*a* was a 15 inch to 20 inch high diffusion flame having approximately a 3 inch diameter.

Next, the voltage source 110 was energized and the results observed. The National Instruments PXI-5412 waveform generator was adjusted to triangular wave to produce an 800 Hz approximately triangular waveform having a calculated voltage of ±40 kV (the bottom of the triangular wave being amplified to −40 kV and the top of the triangular wave being amplified to +40 kV with zero voltage crossings therebetween).

Upon application of voltage to the charge electrode 112 and the shape electrode 116, the flame 109 was found to immediately transform from the natural shape indicated as 109*a* to a flattened shape indicated as 109*b*. The flattened flame 109*b* was observed to be brighter (more luminous) than the shape 109*a*. No visible soot was observed. It was concluded that the entirety of the combustion reaction was occurring within the compressed volume of the flame 109*b*. As indicated by earlier experiments, it was believed that the compressed flame 109*b* corresponded to a greater extent of reaction (more conversion of fuel to carbon dioxide, greater heat output, less soot, and less carbon monoxide output) than the extent of reaction of the larger 109*a* flame.

Figure 6:
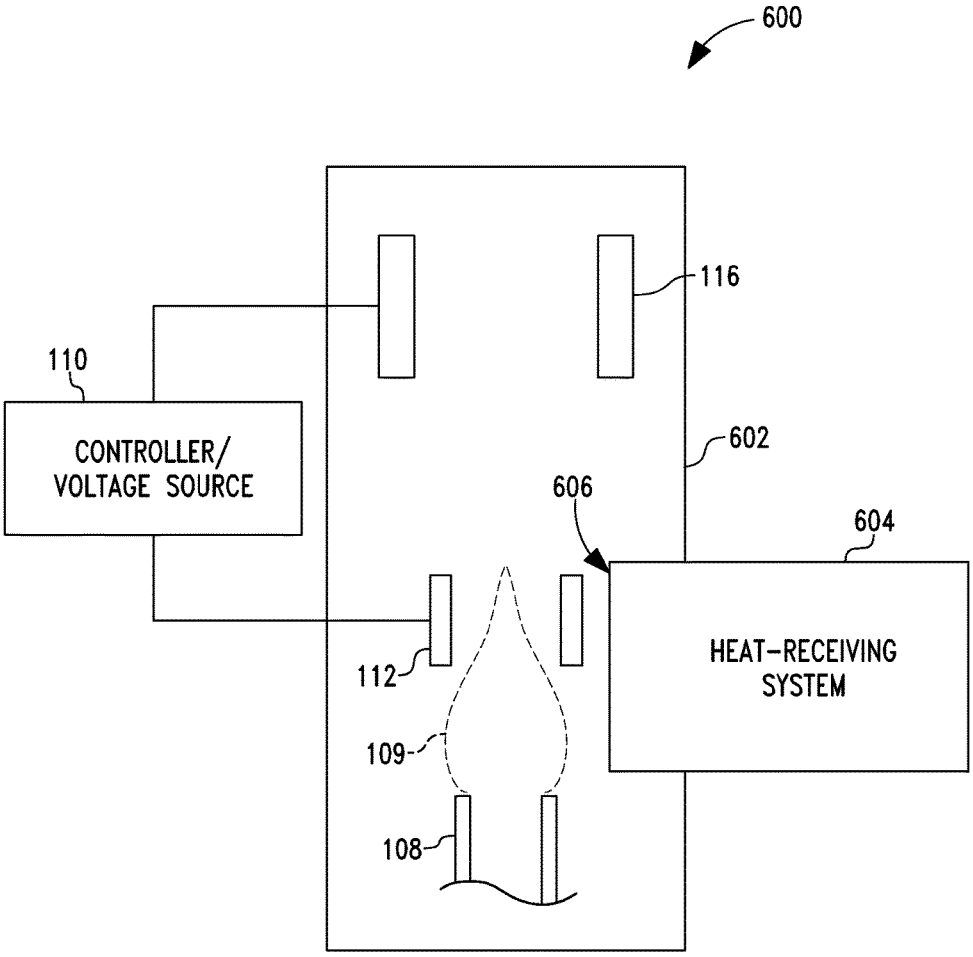
FIG. 6 is a schematic diagram of system including an apparatus for flattening a flame, according to an embodiment.

FIG. 6 is a schematic diagram of system 600 including an apparatus for flattening a flame, according to an embodiment. The system 600 includes elements described with reference to FIG. 1, including a burner 108 configured to support a flame 109, a charge electrode 112, a shape electrode 116, and a controller/voltage source 110. Additionally, the system 600 includes a burner housing 602 and an apparatus 604 configured to receive heat from the flame 109, including a surface 606 configured to receive energy from the flame 109. The apparatus 604 can include, for example, an industrial process, a heating system, an electrical power generation system, a land vehicle, watercraft, or aircraft, and/or a structure configured to hold a workpiece to receive energy from the flame.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed:

1. An apparatus for flattening a flame, comprising:

a charge electrode disposed proximal to a burner, configured to be at least intermittently in contact with a flame supported by the burner;

a shape electrode disposed distal to the burner relative to the charge electrode; and a voltage source operatively coupled to the charge electrode and the shape electrode, and configured to apply to the charge electrode and shape electrode respective substantially in-phase time-varying electrical potentials having a same frequency, wherein the charge electrode is configured to impart to the flame an electrical charge having instantaneously a same sign as the time-varying electrical potential applied to the charge electrode.

2. The apparatus for flattening a flame of claim 1, further comprising:

the burner.

3. The apparatus for flattening a flame of claim 2, further comprising:

a fuel feed rate apparatus configured to control a fuel feed rate to the burner; and a fuel controller operatively coupled to the fuel feed rate apparatus and configured to cause the fuel feed rate apparatus to increase the fuel feed rate when the voltage source applies to the charge electrode and shape electrode the substantially in-phase time-varying electrical potentials.

4. The apparatus for flattening a flame of claim 3, wherein the fuel feed rate apparatus includes an actuated valve for controlling a flow rate of a fuel to the burner.

5. The apparatus for flattening a flame of claim 3, wherein the fuel feed rate apparatus includes an auger or eductor-jet pump for delivering a pulverized solid fuel to the burner.

6. The apparatus for flattening a flame of claim 3, wherein the fuel controller is configured to cause a rate of fuel feed to the burner that would cause flame blow-off in the absence of applying the substantially in-phase time varying electrical potentials to the charge electrode and the shape electrode.

7. The apparatus for flattening a flame of claim 1, wherein the shape electrode includes a toroid.

8. The apparatus for flattening a flame of claim 7, wherein the shape electrode includes a torus.

9. The apparatus for flattening a flame of claim 1, wherein the charge electrode includes a rod disposed at least partially within the flame.

10. The apparatus for flattening a flame of claim 1, wherein the charge electrode includes a torus disposed at least partially within the flame.

11. The apparatus for flattening a flame of claim 1, wherein the charge electrode includes a conductive portion of the burner.

12. The apparatus for flattening a flame of claim 1, wherein each of the time-varying electrical potentials includes a periodic electrical potential.

13. The apparatus for flattening a flame of claim 1, wherein each of the time-varying electrical potentials includes a sign-varying waveform.

14. The apparatus for flattening a flame of claim 1, wherein each of the time-varying electrical potentials includes a periodic voltage waveform.

15. The apparatus for flattening a flame of claim 14, wherein the periodic voltage waveform includes one of a sinusoidal waveform, square waveform, triangular waveform, sawtooth waveform, or Fourier series waveform.

16. The apparatus for flattening a flame of claim 14, wherein each of the time-varying electrical potentials includes an AC voltage waveform.

17. The apparatus for flattening a flame of claim 1, wherein the voltage source is configured to apply to one or both of the charge electrode and the shape electrode a voltage having a magnitude that would cause dielectric breakdown if the voltage were not time-varying.

18. The apparatus for flattening a flame of claim 1, wherein the voltage source is configured to apply to each of the charge electrode and the shape electrode a periodic electrical potential having a frequency between 50 and 10,000 Hertz.

19. The apparatus for flattening a flame of claim 18, wherein the voltage source is configured to apply to each of the charge electrode and the shape electrode a periodic electrical potential having a frequency between 50 and 1000 Hertz.

20. The apparatus for flattening a flame of claim 1, wherein the voltage source is configured to apply to one or both of the charge electrode and the shape electrode a time-varying electrical potential of ±1000 Volts to ±115,000 Volts.

21. The apparatus for flattening a flame of claim 20, wherein the voltage source is configured to apply to one or both of the charge electrode and the shape electrode a time-varying electrical potential of ±8000 Volts to ±40,000 Volts.

22. The apparatus for flattening a flame of claim 1, wherein the voltage source is configured to maintain a voltage ratio between the charge electrode and the shape electrode.

23. The apparatus for flattening a flame of claim 1, wherein the voltage source is configured to apply substantially the same voltage to the charge electrode and the shape electrode.

24. The apparatus for flattening a flame of claim 1, wherein the charge electrode, the shape electrode, and the voltage source are configured to cooperate to avoid dielectric breakdown.

25. The apparatus for flattening a flame of claim 1, wherein the voltage source is configured to output the time-varying electrical potentials in-phase; and further comprising:

electrical leads from the voltage source to the charge electrode and the shape electrode;

wherein the apparatus is configured to cause the time-varying electrical potentials applied to the shape electrode and the charge electrode to differ by no more than a difference attributable to a propagation delay through the electrical leads.

26. The apparatus for flattening a flame of claim 1, wherein the charge electrode, the shape electrode, and the voltage source are configured to cooperate to compress the flame into an etendue smaller than an etendue of the flame would be without application of the time-varying electrical potential.

27. The apparatus for flattening a flame of claim 1, further comprising:

a burner housing having smaller volume than a burner housing would need to be for a flame without application of the time-varying electrical potential.

28. The apparatus for flattening a flame of claim 1, further comprising:

a surface configured to receive energy from the flame.

29. The apparatus for flattening a flame of claim 1, further comprising:

an industrial process configured to receive energy from the flame.

30. The apparatus for flattening a flame of claim 1, further comprising:

a heating system configured to receive energy from the flame.

31. The apparatus for flattening a flame of claim 1, further comprising:

an electrical power generation system configured to receive energy from the flame.

32. The apparatus for flattening a flame of claim 1, further comprising:

one of a land vehicle, watercraft, or aircraft including an apparatus configured to receive energy from the flame.

33. The apparatus for flattening a flame of claim 1, further comprising:

a structure configured to hold a workpiece to receive energy from the flame.

34. The apparatus for flattening a flame of claim 1, wherein the voltage source further comprises:

an electrode controller; and the apparatus further comprising:

one or more sensors operatively coupled to the electrode controller and configured to sense one or more attributes of the flame or combustion gas produced by the flame;

wherein the electrode controller is configured to determine one or more of a voltage, a frequency, a waveform, a phase, or an on/off state corresponding to the time-varying electrical potentials applied to the charge electrode and the shape electrode.

35. The apparatus for flattening a flame of claim 1, wherein the voltage source further comprises:

an electrode controller including a logic circuit, a waveform generator, and at least one amplifier configured to cooperate to apply the time-varying electrical potentials to the charge electrode and the shape electrode.

36. The apparatus for flattening a flame of claim 1, wherein the charge electrode is positioned and configured to be in contact with the flame supported by the burner.

37. The apparatus for flattening a flame of claim 1, wherein the shape electrode includes an axis of revolution aligned with a longitudinal axis of the burner.

38. A method for flattening a flame, comprising:

supporting a flame by emitting fuel from a burner;

applying a first time-varying voltage to a charge electrode positioned proximal to the burner and at least intermittently in contact with the flame;

imparting a time-varying charge to the flame, having instantaneously a same sign as the first time-varying voltage; and applying a second time-varying voltage, substantially in phase with the first time-varying voltage and having a same frequency as the first time-varying voltage, to a shape electrode positioned distal to the burner relative to the charge electrode.

39. The method for flattening a flame of claim 38, wherein applying the first and second time-varying voltages to the charge electrode and the shape electrode causes the flame to flatten into a smaller volume compared to a volume of the flame if the time-varying voltages were not applied.

40. The method for flattening a flame of claim 38, wherein applying the first and second time-varying voltages to the charge electrode and the shape electrode causes the flame to increase in brightness compared to a brightness of the flame if the time-varying voltages were not applied.

41. The method for flattening a flame of claim 38, wherein applying the first and second time-varying voltages to the charge electrode and the shape electrode causes the flame to maintain or increase its heat output compared to a heat output of the flame if the time-varying voltages were not applied.

42. The method for flattening a flame of claim 38, further comprising:

controlling a fuel feed rate to increase the rate of fuel fed to the flame when the first and second time varying voltages are applied to the charge electrode and the shape electrode.

43. The method for flattening a flame of claim 42, wherein controlling a fuel feed rate includes actuating a valve for controlling a flow rate of a gaseous or liquid fuel to the burner.

44. The method for flattening a flame of claim 42, wherein controlling a fuel feed rate includes actuating an auger or eductor-jet pump for delivering a pulverized solid fuel to the burner.

45. The method for flattening a flame of claim 42, wherein controlling a fuel feed rate to increase the rate of fuel fed to the flame includes causing a rate of fuel fed to the burner that would cause flame blow-off in the absence of applying the first and second time varying voltages to the charge electrode and the shape electrode.

46. The method for flattening a flame of claim 38, wherein the applying a second time-varying voltage to a shape electrode positioned distal to the burner relative to the charge electrode includes applying the second time-varying voltage to an annular shape electrode.

47. The method for flattening a flame of claim 38, wherein the applying a second time-varying voltage to a shape electrode positioned distal to the burner relative to the charge electrode includes applying the second time-varying voltage to a torus-shaped shape electrode.

48. The method for flattening a flame of claim 38, wherein the applying a first time-varying voltage to a charge electrode positioned proximal to the burner and at least intermittently in contact with the flame includes applying the first time-varying voltage to a rod positioned at least partially within the flame.

49. The method for flattening a flame of claim 38, wherein the applying a first time-varying voltage to a charge electrode positioned proximal to the burner and at least intermittently in contact with the flame includes applying the first time-varying voltage to a torus positioned at least partially within the flame.

50. The method for flattening a flame of claim 38, wherein the applying a first time-varying voltage to a charge electrode positioned proximal to the burner and at least intermittently in contact with the flame includes applying the first time-varying voltage to a conductive portion of the burner.

51. The method for flattening a flame of claim 38, wherein applying the first and second time-varying voltages to the charge electrode and the shape electrode includes applying first and second periodic voltages to the charge electrode and the shape electrode.

52. The method for flattening a flame of claim 51, wherein applying the first and second periodic voltages to the charge electrode and the shape electrode includes applying a sign-varying voltage waveform to each of the charge electrode and the shape electrode.

53. The method for flattening a flame of claim 51, wherein applying the first and second periodic voltages to the charge electrode and the shape electrode includes applying a sinusoidal voltage waveform, a square voltage waveform, a triangular voltage waveform, a sawtooth voltage waveform, or a Fourier series voltage waveform to each of the charge electrode and the shape electrode.

54. The method for flattening a flame of claim 51, wherein applying the first and second periodic voltages to the charge electrode and the shape electrode includes applying an AC voltage waveform to each of the charge electrode and the shape electrode.

55. The method for flattening a flame of claim 38, wherein applying the first and second time-varying voltages to the charge electrode and the shape electrode includes applying voltages having magnitudes that would cause dielectric breakdown if the voltages were not time-varying.

56. The method for flattening a flame of claim 38, wherein applying the first and second time-varying voltages to the charge electrode and the shape electrode includes applying periodic voltages having a frequency between 50 and 10,000 Hertz.

57. The method for flattening a flame of claim 38, wherein applying the first and second time-varying voltages to the charge electrode and the shape electrode includes applying periodic voltages having a frequency between 50 and 1000 Hertz.

58. The method for flattening a flame of claim 38, wherein applying the first and second time-varying voltages to the charge electrode and the shape electrode includes applying voltages having positive and negative amplitudes of between 1000 Volts and 115,000 Volts.

59. The method for flattening a flame of claim 38, wherein applying the first and second time-varying voltages to the charge electrode and the shape electrode includes applying voltages having positive and negative amplitudes of between 8000 Volts and 40,000 Volts.

60. The method for flattening a flame of claim 38, wherein applying the first and second time-varying voltages to the charge electrode and the shape electrode includes maintaining a voltage ratio between the first voltage and the second voltage.

61. The method for flattening a flame of claim 38, wherein applying the first and second time-varying voltages to the charge electrode and the shape electrode includes applying first and second voltages that are substantially equal.

62. The method for flattening a flame of claim 38, wherein applying the first and second time-varying voltages to the charge electrode and the shape electrode includes avoiding dielectric breakdown by selection of the first voltage, the second voltage, and/or a frequency of the first and second time-varying voltages.

63. The method for flattening a flame of claim 38, wherein applying the first and second time-varying voltages to the charge electrode and the shape electrode includes applying voltages through electrical leads from a voltage source to the charge electrode and the shape electrode, respectively; and wherein any phase difference between the first and second time varying voltages applied to the charge electrode and the shape electrode is attributable to a propagation delay through the electrical leads.

64. The method for flattening a flame of claim 38, further comprising:

applying energy from the flame to a surface.

65. The method for flattening a flame of claim 64, wherein applying energy from the flame to a surface includes one or more of applying energy to an industrial process, applying energy to a heating system, applying energy to an electrical power generation system, applying energy to a land vehicle, watercraft, or aircraft, or applying energy to a workpiece.

66. The method for flattening a flame of claim 38, further comprising:

sensing one or more attributes of the flame or combustion gas produced by the flame; and controlling one or more of a voltage, a frequency, a waveform, a phase, or an on/off state corresponding to the first and second time-varying voltages applied to the charge electrode and the shape electrode, responsive to sensing one or more attributes.

67. The method for flattening a flame of claim 38, wherein the applying a first time-varying voltage to a charge electrode positioned proximal to the burner and at least intermittently in contact with the flame includes applying the first time-varying voltage to a charge electrode positioned proximal to the burner and in contact with the flame.

68. A combustion system, comprising:

a burner configured to support a flame;

a first electrode, positioned and configured to receive a voltage potential and to impart a corresponding electrical charge to a flame supported by the burner;

a second electrode, positioned farther from the burner than the first electrode and configured to interact electrically with the flame; and a voltage source coupled to the first and second electrodes, configured to apply a first time-varying voltage potential to the first electrode, and to apply to the second electrode a second time-varying voltage potential that is repulsive to an electrical charge imparted to the flame by the first electrode and that corresponds to the first voltage potential, wherein the first time-varying voltage potential and the second time-varying voltage potential have a same frequency and are substantially in phase with each other.

69. The combustion system of claim 68, wherein the voltage source is configured to maintain one of the first and second time-varying voltage potentials as a ratio of the other of the first and second time-varying voltage potentials.

70. The combustion system of claim 68, wherein the voltage source is configured to apply the first and second time-varying voltage potentials as a same voltage potential.

71. The combustion system of claim 68, wherein the first electrode comprises an electrode positioned so as to be in contact with the flame.

72. The combustion system of claim 68, wherein the first electrode comprises an electrically conductive portion of the burner.

73. A method, comprising:

supporting a flame by emitting fuel from a burner;

imparting an electrical charge to the flame by applying to a first electrode a first time-varying voltage potential; and applying, to a second electrode positioned further from the burner than is the first electrode, a second time-varying voltage potential having a same frequency as the first-time varying voltage potential and being in phase with the first time-varying voltage potential and repulsive to the electrical charge imparted to the flame.

74. The method of claim 73, wherein the second time-varying voltage potential has a same sign as the charge imparted to the flame.

75. The method of claim 73, wherein the applying the first and second time-varying voltage potentials comprises applying one of the first and second time-varying voltage potentials as a ratio of the other of the first and second time-varying voltage potentials.

76. The method of claim 73, wherein the applying the first and second time-varying voltage potentials comprises applying the first and second voltage potentials as a same voltage potential.

77. The method of claim 73, wherein the applying the first time-varying voltage potential comprises applying the first voltage potential to an electrically conductive portion of the burner.

78. The method of claim 73, wherein the first electrode is positioned in electrical contact with the flame.

* * * * *